United States Patent [19]

Mester

[11] 4,035,649

[45] July 12, 1977

[54] X-RAY GENERATOR FOR A TOMOGRAPHY APPARATUS

[75] Inventor: Heinz Mester, Hamburg, Germany

[73] Assignee: U.S. Philips Corporation, New York, N.Y.

[21] Appl. No.: 716,699

[22] Filed: Aug. 23, 1976

Related U.S. Application Data

[63] Continuation of Ser. No. 512,842, Oct. 7, 1974, abandoned.

[30] Foreign Application Priority Data

Oct. 8, 1973 Germany ..... 2350391

[51] Int. Cl.[2] ..... H05G 1/30

[52] U.S. Cl. ..... 250/409; 250/322; 250/445 T; 250/402

[58] Field of Search ..... 250/401, 402, 408, 409, 250/322; 315/107

[56] References Cited

U.S. PATENT DOCUMENTS

| | | | |
|---|---|---|---|
| 3,521,067 | 7/1970 | Splain | 250/409 |
| 3,894,235 | 7/1975 | Franke | 250/409 |
| 3,911,273 | 10/1975 | Franke | 250/401 |
| 3,971,945 | 7/1976 | Franke | 250/402 |

*Primary Examiner*—Alfred E. Smith
*Assistant Examiner*—B. C. Anderson
*Attorney, Agent, or Firm*—Frank R. Trifari

[57] ABSTRACT

In spite of optimum density on the film, tomography using automatic exposure control can produce exposures which have a less pronounced movement unsharpness than could be expected on the basis of the geometrical proportions. It was found that such effects always occur when the tube power resulting from the exposure control substantially deviates from the tube power initially adjusted. Therefore, means are provided which enable, in dependence of this difference, the exposure data to be changed for the next exposures of a series of tomographic exposures.

1 Claim, 3 Drawing Figures

X-RAY GENERATOR FOR A TOMOGRAPHY APPARATUS

This is a continuation of application Ser. No. 512,842, filed Oct. 7, 1974 abandoned.

The invention relates to an X-ray generator for a tomography apparatus comprising a radiation detector for supplying a signal which is dependent of the radiation intensity or of the dose behind the object, means responsive thereto for automatically controlling the power of the X-ray tube, and for establishing an initial current through the X-ray tube at the start of a tomographic exposure in dependence of exposure data.

X-ray generators for tomography apparatus comprising a radiation detector supplying a signal which is dependent on the dose behind the object and which can be used for controlling the power of the X-ray tube, are known (German Offenlegungsshrift No. 1,946,036). By such control a radiation intensity associated with the exposure time for the tomographic exposure is adjusted and kept constant such that after the termination of the tomographic exposure the nominal dose required for optimum density on the film is obtained.

In apparatus of this kind used in practice the operator must determine the following exposure data before the start of a tomographic exposure: the tube voltage, the focus (in X-ray tubes having different foci), the tomographic pattern, (i.e. the pattern along which the X-ray tube is to be moved during the exposure), and the exposure time. The tube current is not adjusted by the operator but is governed by the control system. The current flowing at the start of the exposure (the initial current) is automatically obtained from a computer that determines the permissible tube current from the exposure data, focus, tube voltage, and exposure time, and controls the adjusting member for the tube current such that at the start only a predetermined fraction of the permissible tube current flows with the result that a reserve in the direction of higher tube powers is available for correction by means of the tube current.

The advantage of such X-ray generators is that even an inexperienced operator can always make correctly exosed tomographic exposures. However, it was found that many of the tomographic exposures made using X-ray generators of the kind set forth have substantially less movement unsharpness than could be expected on the basis of the geometrical proportions, while other tomographic exposures give the impression that a normal (Bucky) exposure were superimposed thereon. For example, ribs maybe imaged which, considering the geometrical proportions per se, should not have been sharply imaged. In X-ray generators without automatic exposure i.e. without tube power control in dependence of the dose power or the dose, these effects were not observed.

SUMMARY OF THE INVENTION

The invention has for its object to realize an X-ray generator of the kind set forth such that the appearance of the described effects is avoided in at least the majority of the tomographic exposures.

According to the invention, this object is achieved in an apparatus of the kind set forth wherein the initial current can also be adjusted independent of the initial current determined on the basis of the exposure data.

The significance of this will be explained with reference to the causes of the described undesirable effects. It was established that these effects alwasy ocur if the radiation intensity measured at the start of a tomographic exposure substantially deviates from the value which is necessary for optimum exposure and which is automatically provided by the control system.

Figure 1:
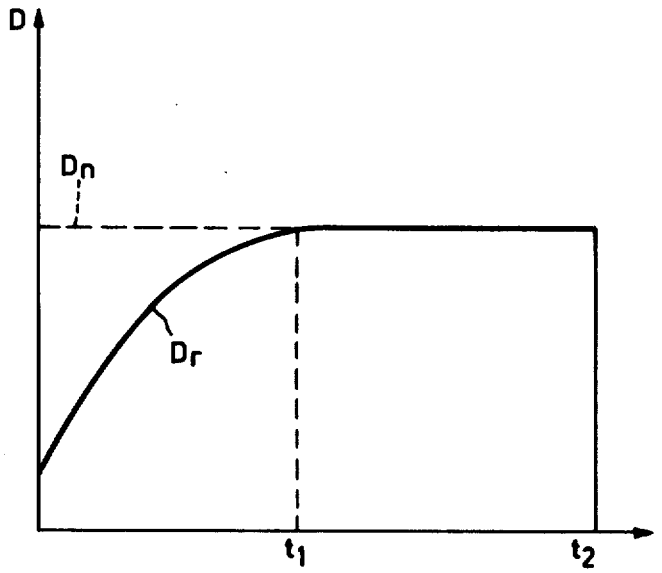
FIG. 1 shows the variation of radiation intensity with respect to time when the initial power is set too low.

FIG. 1 shows the variation in time of the radiation intensity D during a tomographic exposure the initial current having been adjusted such that the intensity Dr measured at the start of the tomographic exposure is substantially smaller than the intensity Dn required for optimum exposure. The measured intensity Dr reaches approximately the nominal value Dn only after a time $t_1$. The exposure is terminated at the instant $t_2$. The radiation emitted by the X-ray tube at the start of the tomographic exposure, i.e. at the beginning of the tomographic pattern, makes substantially no contribution to the exposure of the film. Consequently, the exposure gives the impression that the tube had completed only part of the tomographic pattern, or in other words, as if the tomographic exposure had been made at a smaller tomographic angle. The details situated outside the layer to be sharply imaged thus become less unsharp than could be expected.

Figure 2:
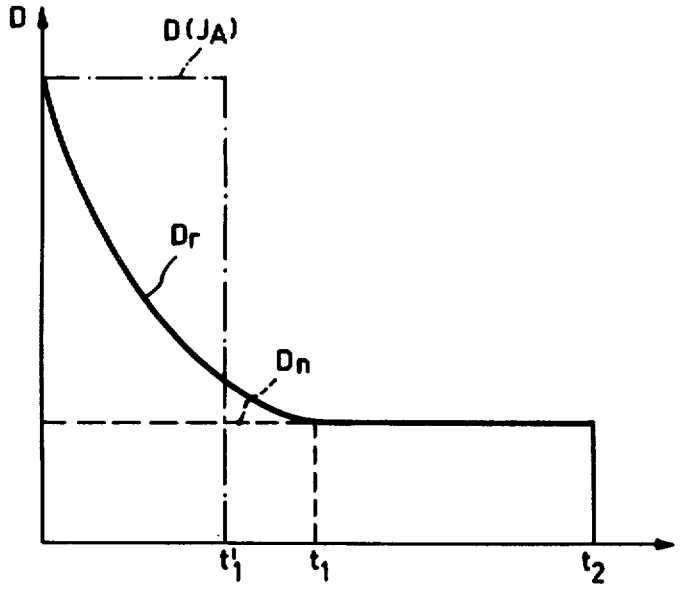
FIG. 2 shows the variation of radiation intensity with respect to time when the initial power is set too high.

FIG. 2 shows the relationships for a tomographic exposure in which the measured intensity Dr at the start of the tomographic exposure is substantially higher than the nominal intensity Dn required for optimum exposure. Such a variation of the intensity gives the impression that a Bucky exposure (of the initial projection) having the intensity Dr—Dn is superimposed on an optimum tomographic exposure (with the intensity Dn). Objects outside thhe tomographic plane to be sharply imaged, particularly those strongly accentuated in the initial projection, for example ribs, therefore have less unsharpness than could be expected.

The desired effect could in principle be avoided if the dose or the intensity could be controlled by fast adjusting members for which $t_1 << t_2$. However, since the exposure times may be as short as 0.4 $s$, this requirement can be satisfied only by using very expensive adjusting members. Another possibility of eliminating the described effects would be to make an X-ray generator operate in combination with an "automatic organ exposure device." Predetermined exposure data, including a defined initial current, are then associated with each organ. It is then possible to address the exposure date by operating a button bearing the name of the relevant organ. Because the absorption ratios (for example, of the stomach) of patients of different weight deviate very little with respect to each other, it would thus be possible — if a correction facility is provided for patients of different weight (for example, correction of the tube voltage or the density) — to make tomographic exposures in which there are no extreme differences between the radiation intensity measured at the start of the exposure and the nominal intensity, with the result that the described effects would be less significant.

However, this invention relates to X-ray generators for use without an "automatic organ exposure device" and comprising comparatively slow adjusting members for the tube power.

The invention enables variation of the tube current such that the difference between the nominal value and the actual value of the intensity at the start of the tomographic exposure is reduced. The variation of the initial current can be effected by direct influencing of the adjusting member or of the tube current. However, this can alternatively be effected by adjusting the tube voltage or by selecting a different focus, because in apparatus of the kind set forth the initial current is also determined by the focus and the voltage, so that the initial current is thus also (automatically) varied.

The variation can be effected automatically or by the operator. In order to facilitate the adjustment of a favourable value of the initial current for the operator, in a further preferred embodiment according to the invention a signal which is dependent of the (automatically adjusted) initial current or of the time integral of the initial current over the exposure time controls an indicator. If the value of the induced initial current or of the mAs product corresponding to this initial current deviates too much from values found by experience, the operator can choose a different voltage, a different current or a different focus. However, the operator must have adequate experience or have suitable exposure tables available.

A further preferred embodiment according to the invention is characterized in that there are provided a measuring member for measuring the product of the tube current and the time (mAs product) during the exposure, and an indicator for indicating the measured mAs product or the mean tube current during the exposure. On the basis of the mAs product measured or the mean tube current, determined by division of the mAs product by the exposure time, the exposure data for the subsequent tomographic exposures of the same object can be corrected. The indication can then be effected, for example, by a combined indicator/adjusting unit comprising a series of buttons for adjusting different initial currents, each time the button being illuminated representing the initial current nearest to the mean current. As already stated, the indication of the mean current measured during a (first) tomographic exposure enables only the correction of the (further) tomographic exposures of the same object. However, since a whole series of tomographic exposures is always made during an X-ray examination using a tomography apparatus, this limitation is not disturbing. The fact that the initial exposure is liable to exhibit the described undesirable effects under given conditions is usually acceptable; the important fact is that the correction is not effected in dependence of values based on the operator's experience, but in dependence of values measured, and the latter procedure is much more exact.

A yet further preferred embodiment of the device according to the invention comprises a comparison device which, after expiration of a preset time after the start of the exposure, generates a signal which is dependent of the difference between the dose measured thus far and the nominal dos necessary for uniform exposure, the said signal controlling adjusting members for the tube power for the next tomographic exposure and/or an indicator. When such a comparison device is used for controlling the adjusting members for the tube power, the exposure data for the subsequent tomographic exposure are automatically corrected.

Instead of comparing the dose measured at the start of the exposure with the nominal dose required for uniform exposure or with quantities proportional thereto, for example, the corresponding mAs products. the radiation intensity measured at the start of the tomographic exposure could alternatively be compared with the mean nominal radiation intensity (or quantities proportional thereto, for example, the initial current and the mean exposure current) required for uniform exposure. The measurement of the difference between said radiation intensities, however, imposes given problems; because differences between the mean tube current and the initial current may also be attributable to a different absorption of the X-radiation in the object, a comparison of the initial current and the mean tube current may give rise to incorrect conclusions.

In another preferred embodiment according to the invention, the comparison device integrates a signal corresponding to the measured current and a signal corresponding to the initial current during a time to be preset, and forms the difference between the mAs products thus obtained. Because the tube current is proportional to the radiation intensity — in the case of constant absorption circumstances — the mAs product measured during the time to be preset is proportional to the radiation intensity measured at the start of the exposure; the radiation intensity D (IA) corresponding to the initial current is not proportional to the nominal value Dn of the radiation intensity (see FIG. 2). However, the difference between the mAs product corresponding to the initial current and the measured mAs product is larger as the difference between the dose measured during the preset time and the nominal dose required during this time is larger. Therefore, the diference between said mAs products can also be used for controlling the adjusting members or the indicator.

The difference between the mAs products, induced by the indicator in accordance with value and direction, can then possibly be utilized for manual correction of the exposure data.

In yet another preferred embodiment yet according to the invention, the difference between the dose at the start of an exposure and the nominal dose can be measured in that the comparison device forms the differece between the dose measured at the start of an exposure and the dose measured at the end of an exposure, the measuring periods being each time equal. This is because the dose at the end of an exposure corresponds to the nominal dose, since till this instant the tube power was varied such that the nominal radiation intensity results therefrom. Because the dose at the start of the tomographic exposure cannot be measured simultaneoulsy with the dose at the end of the tomographic exposure, it is necessary to store at least the value of the dose measured at the start; however, this does not impose any problems because the dose is usually measured by way of integrating members which are capable of storing the measured values for at least a brief period of time.

Figure 3:
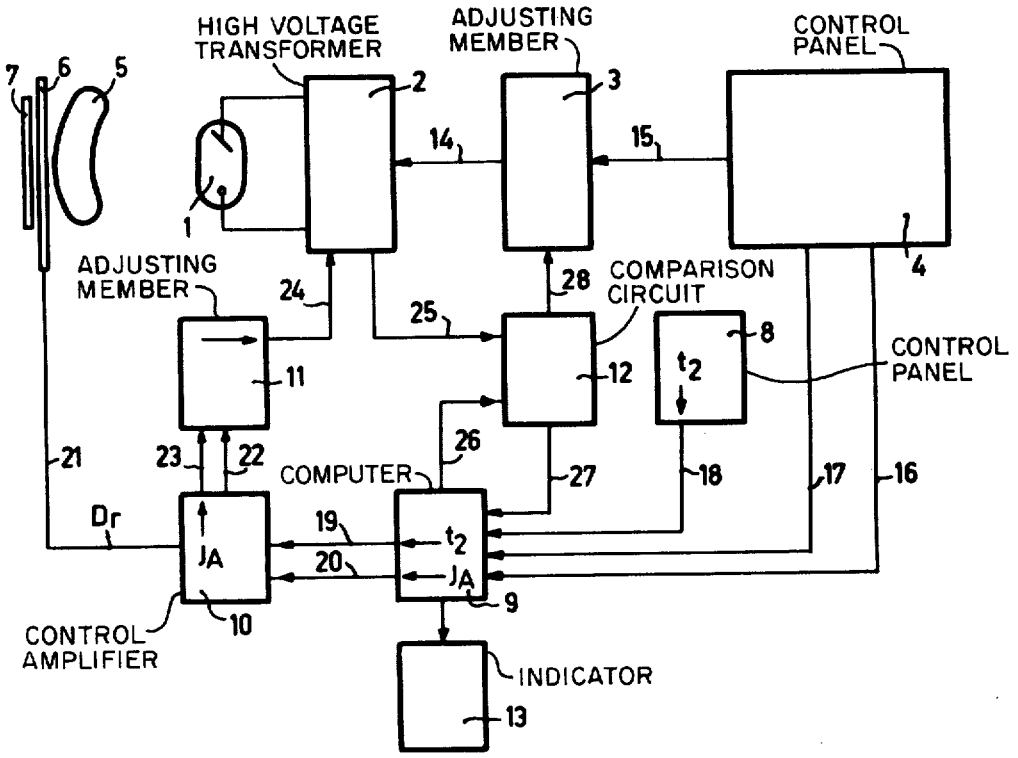
FIG. 3 diagrammatically shows the preferred embodiment of this invention.

The invention will now be described in detail with reference to FIG. 3 which diagrammatically shows one embodiment according to the invention.

An X-ray tube 1 receives its power supply from a high-voltage transformer 2, the primary windings of which are connected, via a lead 14, to an adjusting member 3 for the tube voltage which is connected, via a lead 15, to a generator for the nominal value in a control panel 4 on which, in addition to the tube voltage, inter alia the focus of the X-ray tube used for the tomographic exposure can also be adjusted. Arranged in the beam path of the X-ray tube 1 is a patient 5, there behind a measuring detector 6 for the radiation intensity, and therebehind again a film 7 (the movement mechanism required for a tomography apparatus in order to shift the film and the X-ray tube in opposite directions is not shown in the drawing). The exposure time is adjusted on a control panel S of the tomography apparatus. Via leads 16, 17, 18, exposure data (tube voltage, focus and exposure time) adjusted on the control panels 4 and 8 are applied to a computer 9. On the basis of these exposure data the computer 9 calculates the permissible tube current and the initial current, corresponding to a fraction of the permissible tube current which is to be preset by the operator. The initial current thus determined and the exposure time are applied, via control leads 19 and 20, to a control amplifier 10 which acts, via a lead 23, on an adjusting member 11 for adjusting the filament current corresponding to the initial current AI, the said adjusting member influencing, via a lead 24, the filament circuit of the X-ray tube 1. The control amplifier 10 also determines the nominal radiation intensity required for the selected exposure time to ensure optimum exposure of the film, and compares this intensity with the radiation intensity measured via the detector 6 and applied via the lead 21. On the basis of the control difference, a signal is formed which is applied to the filament current adjusting member 11 via the lead 24. The X-ray generator described thus far is known.

In order to enable intervention by the operator if the adjusted initial current AI or the mAs product resulting therefrom and from the exposure time deviate too much from values known from experience, an indicator 13 is provided on which the operator can read the initial current. The operator can thus make corrections in the exposure data already before the first tomographic exposure. For the automatic correction of the exposure data for the next tomographic exposures, a comparison circuit 12 is provided, one input of which receives, via a lead 25, a signal corresponding to the tube current measured, its other input recieving, via a lead 26, a signal corresponding to the initial current A1. Both signals are integrated during a period $t_1'$ which is shorter than the period $t_1$ at the end of which the radiation intensity reaches the nominal value Dn (see FIG. 2). If the difference between the mAs products thus obtained exceeds a preset threshold value, the initial current is corrected accordingly via a control lead 27 and/or a different tube voltage is selected via a control lead 28. A different focus can then also be adjusted.

Instead of the automatic correction of the exposure data for the next tomographic exposures, the operator can also perform a manual correction; for this purpose in any case an indicator must be provided to indicate the difference between the mAs products measured in the described manner.

What is claimed is:

1. An improved X-ray generator for tomography apparatus of the type having means for automatically establishing an initial tube current for the X-ray tube and for automatically setting the exposure period, a radiation detector for measuring the intensity of radiation reaching the film, and control means responsive to the measured intensity and the set exposure period for automatically adjusting the current of the x-ray tube to an adjusted current which more optimally exposes the film, the current of the X-ray tube being adjusted during an initial time period $t_1$ of the exposure period, the improvement comprising means for integrating the difference between the initial tube current and the actual tube current during an initial time period $t_1'$ of the exposure period, $t_1'$ being less than $t_1$; and means responsive to the integrated difference, when the integrated difference exceeds a predetermined threshold, for automatically correcting the established initial tube current to a corrected value for the next exposure which more closely approximates te adjusted current and which reduces the integrated difference during the next exposure.

* * * * *